US005282988A

United States Patent [19]

Farng et al.

[11] Patent Number: 5,282,988

[45] Date of Patent: Feb. 1, 1994

[54] LUBRICANT ADDITIVES

[75] Inventors: Liehpao O. Farng, Lawrenceville; Arjun K. Goyal, Woodbury; Andrew G. Horodysky, Cherry Hill, all of N.J.

[73] Assignee: Mobil Oil Corporation, Fairfax, Va.

[21] Appl. No.: 787,461

[22] Filed: Nov. 4, 1991

[51] Int. Cl.[5] ..... C10M 137/10

[52] U.S. Cl. ..... 252/46.7; 252/46.6; 558/159; 558/167; 558/168; 558/172; 558/139

[58] Field of Search ..... 252/46.7; 558/167, 168, 558/172, 159, 139

[56] References Cited

U.S. PATENT DOCUMENTS

| | | | |
|---|---|---|---|
| 3,073,858 | 1/1963 | Szabo et al. | 558/172 |
| 3,862,268 | 1/1975 | Schrader et al. | 558/172 |
| 3,980,574 | 9/1976 | Okorodudu | 252/49.9 |
| 4,194,981 | 3/1980 | Hammond et al. | 252/46.7 |
| 4,235,730 | 11/1980 | Schlicht | 252/51.5 |
| 4,387,095 | 6/1983 | Saito et al. | 558/172 |
| 4,544,492 | 10/1985 | Zinke et al. | 252/46.7 |
| 4,599,329 | 7/1986 | Seufert et al. | 558/172 |
| 4,897,087 | 1/1990 | Blain et al. | 44/71 |
| 4,938,884 | 7/1990 | Adams et al. | 252/46.7 |

*Primary Examiner*—Ellen M. McAvoy
*Attorney, Agent, or Firm*—Alexander J. McKillop; Malcolm D. Keen; Jessica M. Sinnott

[57] ABSTRACT

A urethane reaction product, derived from an alkoxylated diorgano phosphorodithioate and an isocyanate, specifically, toluenediisocyanate and hexamethylene diisocyanate, is a multifunctional antiwear and antioxidant additive for lubricants. The isocyanate groups of the reaction product are substantially converted to urethane and/or urea groups through post reaction with active hydrogen compounds such as dibutylamine, bis(2-hydroxethyl) cocoamine and alcohols such as 2-propanol.

23 Claims, No Drawings

LUBRICANT ADDITIVES

FIELD OF THE INVENTION

The invention relates to antiwear, antioxidant and rust inhibiting additives for lubricants. Specifically, the invention relates to urethane derivatives of diorgano phosphorodithioic acid and isocyanate as lubricant additives.

BACKGROUND OF THE INVENTION

Direct frictional contact between relatively moving surfaces even in the presence of a lubricant can cause wear of the surfaces. The elimination of wear is an ideal goal which is approached by blending the lubricating media with additives which can reduce the wear. The most suitable antiwear additives are those that help to create and maintain a persistent film of lubricant even under severe conditions which would tend to dissipate the lubricant film such as high temperatures which thin the lubricant film and extreme pressures which squeeze the lubricant film away from the contacting surfaces. Wear is most serious in internal combustion engines, diesel engines and gasoline engines in which metal parts are exposed to sliding, rolling and other types of forceful, frictional mechanical contact. Specific areas of wear occur in the gears, particularly hypoid gears which are under high loads, piston rings and cylinders and bearings such as ball, sleeve and roller bearings. Since antiwear lubricants are made by incorporating antiwear additives into the lubricating fluid, compatibility of the additive is important. Compatibility is a problem encountered in the art because the antiwear functionality is usually polar which makes that portion insoluble in the lubricant. It is desirable to make antiwear additives which maintain the antiwear functionality while at the same time are soluble in the lubricant fluid.

Rust prevention is important in machines which are made from ferrous alloys, other than stainless steel, which are subject to rusting upon exposure to humid air. Mineral oils notoriously do not have good rust preventative properties and have; therefore, been mixed with appropriate antirust additives. While synthetic oils have better antirust properties they too can benefit from compatible antirust additives. Antirust additives are usually hydrophobic polar compounds which are adsorbed at the metal surface to shield the surface from exposure to corrosive compounds present in the environment. Known antirust additives of this kind include esters of phosphorus acids. Other antirust additives have the ability to neutralize the acidity of the lubricant as oxidation occurs. Antirust additives of this kind which are particularly useful under relatively high temperature conditions are nitrogenous compounds; e.g. alkyl amines and amides.

Oxidation of a lubricating oil occurs during ordinary, as well as severe, conditions and use. The properties of the oil change due to contamination of the oil and chemical changes in the oil molecules. Oxidation can lead to bearing corrosion, ring sticking, lacquer and sludge formation and excessive viscosity. Acid and peroxide oxidation products can promote corrosion of metal parts, particularly in bearings. The presence of an antioxidant can have a profound effect upon the rate of oxidation of the lubricating oil. Known antioxidants include hydroxy compounds, such as phenols, nitrogen compounds such as amines and phosphorothioates, particularly zinc dithiophosphates.

The use of phosphorodithioate compositions, specifically the zinc dithiophosphates have been known as multifunctional antiwear, peroxide decomposing and bearing corrosion inhibiting additives.

Urea and urethane derivatives have also been described as having good antioxidant characteristics and antiwear properties in lubricants. For example U.S. Pat. No. 3,980,574 describes lubricants containing diorganophosphorus derivatives of urethane as antiwear agents. The additive described in this patent does not contain a phosphorodithioate functional group.

U.S. Pat. No. 4,235,730 describes a polyurethane derived from a diisocyanate and a diol having dispersant properties for lubricants and fuels.

U.S. Pat. No. 4,897,087 describes a reaction product of a polyether and a polyamine which are linked together by a diisocyanate having ashless dispersant and detergent properties for fuels.

SUMMARY OF THE INVENTION

The invention provides a new composition of matter derived from an additive reaction product which is useful as a multifunctional lubricant additive. The additive has displayed excellent antioxidant properties coupled with very good antiwear and antirust activities. The additive has also demonstrated good compatability and stability in lubricants and is believed to have bearing corrosion inhibiting properties. Additional properties which are expected are corrosion inhibition, antirust properties, detergency, thermal stability, extreme pressure, and antifatiguing.

The lubricant additive comprises a reaction product of an alkoxylated diorganophosphorodithioate (diorgano-phosphorodithioate-alkylene oxide addition product) of the formula:

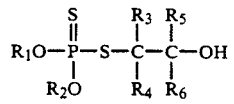

where $R_1$ and $R_2$ are the same or different straight or branched chain hydrocarbyl radicals containing 3 to 30 carbon atoms, $R_3$, $R_4$, $R_5$ and $R_6$ are each independently a hydrogen atom or a hydrocarbyl radical having 1 to 60 carbon atoms and an organo isocyanate characterized by at least one isocyanate group having the structural formula:

$$-N{=}C{=}O$$

the isocyanate group is bonded to an organo group, whereby the reaction product is characterized by at least one urethane group. The invention is also directed to lubricants containing the reaction product as a multifunctional antioxidant and antiwear additive and methods of making the lubricant composition.

DETAILED DESCRIPTION OF THE INVENTION

The alkoxylated diorgano phosphorodithioate starting material is made in a reaction between phosphorus pentasulfide and an alcohol or phenol to form the diorgano phosphorodithioate which is then reacted with an alkylene oxide or epoxide to form the diorgano phosphorodithioate-derived alcohol (also designated the alkoxylated diorgano phosphorodithioate). The reaction mechanism is believed to follow the following scheme:

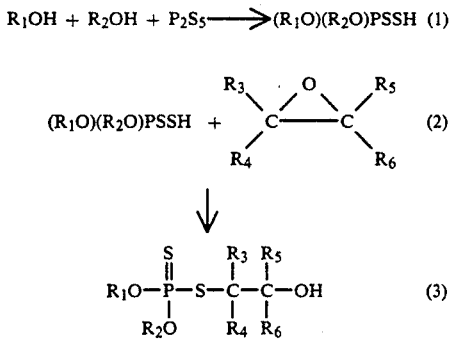

Where $R_1$ and $R_2$ are the same or different straight or branched chain hydrocarbyl radicals containing 3 to 30 carbon atoms or aromatic hydrocarbyls. $R_3$, $R_4$, $R_5$ and $R_6$ are each independently a hydrogen atom or a hydrocarbyl radical having 1 to 60 carbon atoms. Examples of appropriate alcohols for reacting with the $P_2S_5$ are those in which the hydrocarbyl radical, represented by $R_1$ and $R_2$, are propyl, butyl, pentyl, hexyl, octyl, decyl, dodecyl, octadecyl, eicosyl and branched chain hydrocarbyls such as ethylhexyl, methylpropyl, methylpentyl and mixtures thereof. Specific examples of alcohols include methanol, ethanol, n-propanol, i-propanol, n-butanol, i-butanol, dimethyl butanol, primary and secondary pentanols, hexanol, ethylhexanol, eicosanol and mixtures thereof. Other hydrocarbyl radicals contemplated include 2-butanol (1-methylpropanol), 4-methyl-2-pentanol(1,3-dimethylbutanol), methylpropyl alcohol which can be a 1-methylpropanol (i.e., 2-butanol) or 2-methylpropanol (i.e. i-butanol), dimethylbutanol which can be a 1,3-dimethylbutanol (i.e. 4-methyl-2-pentanol) or 3,3-dimethylbutanol or 2,2-dimethylbutanol or 1,1-dimethylbutanol or 2,3-dimethylbutanol. The $P_2S_5$, as mentioned above, can also be reacted with phenolic compounds such as phenol and alkyl-substituted phenol wherein the alkyl group contains 1 to 30 carbon atoms.

Epoxides which are contemplated for making the starting material include $C_1$ to $C_{60}$ alkylene oxides which contain straight or branched chain or cyclic hydrocarbyl radicals represented by $R_3$, $R_4$, $R_5$ and $R_6$. Representative examples of suitable epoxides include: ethylene oxide, propylene oxide, butylene oxide, pentylene oxide, decylene oxide, dodecylene oxide, hexadecylene oxide, octadecylene oxide, styrene oxide, stilbene oxide and cyclohexene oxide, isomers thereof and mixtures thereof.

The phosphorodithioates can be obtained commercially or they can be made by reacting the alcohol with phosphorus pentasulfide in a ratio of 4 to 1 at an elevated temperature. Also, a higher or lower ratio of alcohol to phosphorus pentasulfide can be used. The phosphorodithioates so obtained are then reacted with the epoxides to form the alkoxylated diorgano phosphorodithioate starting materials in equimolar proportions at low temperatures, preferably below about 50° C., ranging from −20° to 50° C.

The multifunctional urethane additives of the invention are made from the above-described phosphorodithioate and an organo isocyanate. Contemplated organo isocyanates include the monoisocyanates and the diisocyanates.

The urethane products are made in accordance with the following reaction mechanism:

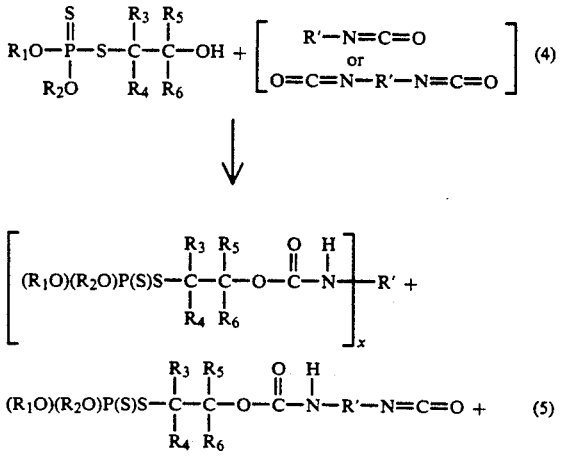

other related structures

Where X is an integer ranging from 1 to 2 and R′ is the organo group of the isocyanate starting material. Preferably the organo group is an aliphatic or aromatic hydrocarbyl group containing 1 to 30 carbon atoms. The organo group can, optionally, contain at least one heteroatom such as oxygen, nitrogen or sulfur. The organo group can also be a combination of aliphatic and aromatic groups and can be alicyclic. The term "aliphatic" as used here indicates a straight or branched chain hydrocarbyl which can be saturated or relatively unsaturated. The term "aromatic" indicates a hydrocarbyl group containing predominantly phenyl groups which can have aliphatic substitution. "Alicyclic" means that the organo group contains saturated cyclic hydrocarbons which can be bonded to phenyl or aliphatic groups. Typical examples of the organo isocyantes contemplated include but are not limited to 4,4′-diphenyl diisocyanate, 4,4′-diphenyl methane diisocyanate, dianisidine diisocyanates, 1,5-naphthalene diisocyanate, 4,4′-diphenyl ether diisocyanate, p-phenylene diisocyanate, trimethylene diisocyanate, tetramethylene diisocyanate, tetramethylxylene diisocyanate, trimethylhexamethylene diisocyanate, ethylene diisocyanate, cyclohexylene diisocyanates, nonamethylene diisocyanate, octadecamethylene diisocyanate, 2-(dimethylamino) pentylene diisocyanate, tetrachlorophenylene-1,4-diisocyanate, 3-heptene diisocyanate, transvinylene diisocyanate, isophorone diisocyanate, toluene-2,4-diisocyanate, and hexamethylene diisocyanate.

Appropriate monoisocyanates which can be used include methyl isocyanate, ethyl isocyanate, phenyl isocyanate or trans2-phenylcyclopropyl-isocyanate which has the structural formula:

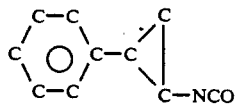

It is preferable for the urethane reaction products to be substantially free of isocyanate groups. Thus, post reaction to convert any isocyanate moiety to a urea or urethane group is necessary for optimum effectiveness. The isocyanate converting agents contemplated are those compounds which contain an active hydrogen. The most suitable are alcohols and phenols. Primary alcohols which react at room temperature as well as secondary and tertiary alcohols which are slower reacting can be used. The reaction of the isocyanate moiety and alcohol yields a urethane moiety; thus, the final reaction product will contain a polyurethane group. Other suitable active hydrogen containing isocyanate converters are basic nitrogens including primary and secondary aliphatic and aromatic amines.

The resulting product is made in accordance with the following reaction mechanism:

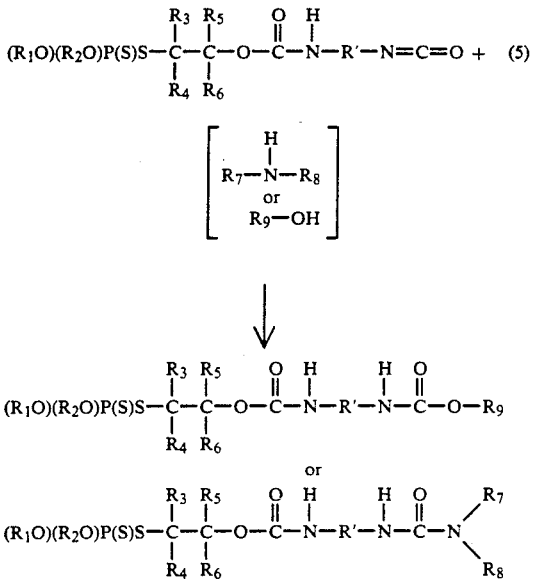

Where $R_7$, $R_8$ and $R_9$ are hydrogen or aliphatic hydrocarbyl groups which include alkyl, aryl, alkaryl, aralkyl or cycloalkyl groups containing 1 to 30 carbon atoms, the nature of the hydrocarbyl group depending upon the active hydrogen-containing reactant. Representative examples of suitable alcohols include 2-propanol, methanol, ethanol, n-propanol, i-propanol, n-butanol, i-butanol, dimethyl butanol, primary and secondary pentanols, hexanol, ethylhexanol, eicosanol and mixtures thereof. Phenols include, phenol, cresol, xylenol, hydroxydiphenyl, amylphenol, benzylphenol, alpha and beta naphthols, and the like. Alkyl substituted phenols are also included. Specific members of this group also include decene dimer phenol, decene trimer phenol, octene dimer and trimer phenol, dodecene dimer and trimer phenol, including mixtures of these.

The amines and the mixtures thereof contemplated herein are preferably those which contain a primary amino group. It is contemplated that these preferred amines include saturated and unsaturated aliphatic primary monoamines containing 1 to 30 carbon atoms and $C_{11}$ to $C_{26}$ branched alkylamines. Examples include a $C_{11}$–$C_{14}$ alkyl amine sold under the tradename "PRIMENE 81R" and a $C_{18}$–$C_{26}$ alkyl amine sold under the tradename PRIMENE JMT by Rohm and Haas Company. Other specific examples include butyl amine, propylamine, hexylamine, cocoamine, oleylamine, octylamine, nonylamine, decylamine, cyclooctylamine, dodecylamine, tetradecylamine, hexadecylamine, octadecylamine, stearylamine, laurylamine, soyamine, dibutylamine, dioctylamine and other secondary amines, ethanolamine, diethanolamines and other alkanolamines including straight chain and branched chain oxyalkylene amines and polyoxyakyleneamines such as ethyloxyamines, propyloxyamines, polyetherdiamines, bis(hydroxypropylamines), and bis(hydroxyethylamines), i.e., bis(2-hydroxyethyl)cocoamine. Secondary amines and combinations thereof are also contemplated. For example, diethylene triamine, triethylene tetramine, tetraethylene pentamine, pentaethylene hexamine, and their corresponding propylene amines.

Other suitable amines include but are not limited to triamines such as N-oleyl diethylenetriamine, N-soya diethylenetriamine, N-coco diethylene triamine, N-tallow diethylenetriamine, N-decyldiethylenetriamine, N-dodecyl diethylenetriamine, N-tetradecyl diethylenetriamine, N-octadecyl diethylenetriamine, N-eicosyl diethylenetriamine, N-triacontyl diethylenetriamine, N-oleyl dipropylenetriamine, N-soya dipropylenetriamine, N-coco dipropylenetriamine, N-tallow dipropylenetriamine, N-decyl dipropylene triamine, N-dodecyl dipropylenetriamine, N-tetradecyl dipropylenetriamine, N-octadecyl dipropylenetriamine, N-eicosyl dipropylenetriamine, N-triacontyl dipropylenetriamine, the corresponding N-$C_{10}$ to $C_{30}$ hydrocarbyl dibutylenetriamine members as well as the corresponding mixed members, as for example the N-$C_{10}$ to $C_{30}$ hydrocarbyl dibutylenetriamine members as well as the corresponding mixed members, as for example, the N-$C_{10}$ to $C_{30}$ hydrocarbyl ethylenebutylenetriamine and the corresponding propylenebutylenetriamine. Cyclic amines are also contemplated and include cyclohexylamine and dicyclohexylamine.

The procedure for making the urethane additives of the invention involve first contacting the diorgano phosphorodithioate-derived alcohol adduct (i.e. phosphorodithioate-alkylene oxide adduct) with isocyanate in proportion expressed in terms of molar ratios ranging from 1:10 to 10:1, preferably 1 to 1, at ambient temperature for 5 minutes to 10 hours.

In the post reaction with the isocyanate converting agent to convert any remaining isocyanate to urethane or urea, the reactants can be contacted in equimolar proportions. However, a molar excess of the converting agent can be used. This reaction can be carried out in the presence of a catalyst to promote the reaction, a preferred catalyst is diazabicyclo[2.2.2.]octane or a tertiary amine such as triethylamine. The temperature of reaction can be elevated to at least about 150° C., ranging from 30 to 150° C. The reactants can be contacted for 5 minutes to 10 hours, preferably from 30 minutes to 3 hours.

The reaction products are most effective when blended with lubricants in a concentration of about 0.01% to 10%, preferably, from 0.1% to 2% by weight of the total composition.

The contemplated lubricants are liquid oils in the form of either a mineral oil or synthetic oil or mixtures thereof. Also contemplated are greases in which any of the foregoing oils are employed as a base. Still further materials which it is believed would benefit from the reaction products of the present invention are fuels.

In general, the mineral oils, both paraffinic and naphthenic and mixtures thereof can be employed as a lubricating oil or as the grease vehicle. The lubricating oils can be of any suitable lubrication viscosity range, for example, from about 45 SUS at 100° F. to about 6000 SUS at 100° F., and preferably from about 50 to 250 SUS at 210° F. Viscosity indexes from about 70 to 95 being preferred. The average molecular weights of these oils can range from about 250 to about 800.

Where the lubricant is employed as a grease, the lubricant is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount sufficient to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

Where synthetic oils, or synthetic oils employed as the vehicle for the grease are desired in preference to mineral oils, or in mixtures of mineral and synthetic oils, various synthetic oils may be used. Typical synthetic oils include polyisobutylenes, polybutenes, hydrogenated polydecenes, polypropylene glycol, polyethylene glycol, trimethylol propane esters, silicate esters, silanes, hydrogenated synthetic oils, chain-type polyphenyls, siloxanes and silicones (polysiloxanes) and alkyl-substituted diphenyl ethers.

The lubricating oils and greases contemplated for blending with the reaction product can also contain other additives generally employed in lubricating compositions such as co-corrosion inhibitors, detergents, co-extreme pressure agents, viscosity index improvers, co-friction reducers, co-antiwear agents and the like. Representative of these additives include, but are not limited to phenates, sulfonates, imides, heterocyclic compounds, polymeric acrylates, amines, amides, esters, sulfurized olefins, succinimides, succinate esters, metallic detergents containing calcium or magnesium, arylamines, hindered phenols and the like.

The additives are most effective when used in gear oils. Typical of such oils are automotive spiral-bevel and worm-gear axle oils which operate under extreme pressures, load and temperature conditions, hypoid gear oils operating under both high speed, low-torque and low-speed, high torque conditions.

Industrial lubrication applications which will benefit from the additives include circulation oils and steam turbine oils, gas turbine oils, for both heavy-duty gas turbines and aircraft gas turbines, way lubricants, mist oils and machine tool lubricants. Engine oils are also contemplated such as diesel engine oils, i.e., oils used in marine diesel engines, locomotives, power plants and high speed automotive diesel engines, gasoline burning engines, such as crankcase oils and compressor oils.

Functional fluids also benefit from the present additives. These fluids include automotive fluids such as automatic transmission fluids, power steering fluids and power brake fluids.

It is also desirable to employ the additive in greases, such as, automotive, industrial and aviation greases, and automobile chassis lubricants.

When the additives are utilized in fuels, the fuels contemplated are liquid hydrocarbon and liquid oxygenated fuels such as alcohols and ethers. The additives can be blended in a concentration from about 25 to about 500 pounds of additive per 1000 barrels of fuel. The liquid fuel can be a liquid hydrocarbon fuel or an oxygenated fuel or mixtures thereof ranging from a ratio of hydrocarbon fuel to oxygenated fuel from about 99:1 to about 1:99. Liquid hydrocarbon fuels include gasoline, fuel oils, diesel oils and alcohol fuels include methyl and ethyl alcohols and ethers.

Specifically, the fuel compositions contemplated include gasoline base stocks such as a mixture of hydrocarbons boiling in the gasoline boiling range which is from about 90° F. to about 450° F. This base fuel may consist of straight chains or branched chains or paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point from about 75° F. to about 135° F. and an end boiling point from about 250° F. to about 750° F. It should be noted in this respect that the term distillate fuels is not intended to be restricted to straight-run distillate fractions. These distillate fuel oils can be straight-run distillate fuel oils catalytically or thermally cracked (including hydrocracked) distillate fuel oils etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as Diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing little or no hydrocarbon. Typical of such fuels are methanol, ethanol and mixtures of methanol and ethanol. The fuels which may be treated with the additive include gasohols which my be formed by mixing 90 to 95 volumes of gasoline with 5–10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

EXAMPLES

The following examples, which were actually conducted, represent a more specific description of the invention.

EXAMPLE 1

Propoxylated Di-(2-ethylhexyl)phosphorodithioic acid (O,O-di-2-ethylhexyl-S-(2-hydroxypropyl)phosphorodithioate)

Approximately 708.7 gm of di-(2-ethylhexyl)phosphorodithioic acid (commercially obtained from ICI America Company) was charged into a one liter stirred reactor equipped with a condenser and a thermometer. Approximately 116.2 gm of propylene oxide (equal molar) was slowly added over a course of two hours. The reaction temperature was controlled at or below 40° C. by using ice-water bath for cooling. At the end of the addition, the reaction mixture changed its color from dark-greenish to light yellowish. It weighed approximately 826 gm.

EXAMPLE 2

Propoxylated Di-(4-Methyl-2-Pentyl)Phosphorodithioic Acid

Into a four-necked flask equipped with a stirrer, condenser, dropping funnel and thermometer were added 838 g (8.2 moles) of 4-methyl-2-pentanol and the contents were heated to 60° C. At that temperature, 444.5 g (2.0 mole) of phosphorus pentasulfide were added protionwise over a three-hour period with agitation. After all of the sulfide reactant was introduced, the temperature was raised to 65° C. and held for three hours. The evolution of hydrogen sulfide gas indicated a substantially complete reaction and the hydrogen sulfide gas was trapped by a caustic scrubber. The reaction was then allowed to cool to ambient temperature under a nitrogen blanket and the solution was filtered through diatomaceous earth to produce a greenish fluid (1158.5 g) as desired phosphorodithioic acid.

This phosphorodithioic acid was further reacted with one equivalent of propylene oxide (232.4 g) following the exact procedure as described in Example 1. At the end of the reaction, the mixture changed its color to light yellowish, and excess unreacted 4-methyl-2-pentanol or propylene oxide was removed by distillation.

EXAMPLE 3

Propoxylated-Di-(2-Methyl-1-Propyl) Phosphorodithioic Acid

The procedure of Example 2 was followed with only one exception: equimolar 2-methyl-1-propanol was used instead of 4-methyl-2-pentanol.

EXAMPLE 4

Reaction Product of S-2-Hydroxypropyl O,O-Di-(2-ethylhexyl) Phosphorodithioate and Toluene 2,4-Diisocyanate Approximately 164.8 g (0.4 mole) of the above product of Example 1 was charged in a reaction flask. Slowly 34.8 g (0.2 mole) of toluene 2,4-diisocyanate (technical grade: 80% 2,4-TDI and 20% 2,6-TDI) was added dropwise into the reactor at ambient temperature. This mixture was then heated at 90° C. for two hours, at 110° C. for three hours. Thereafter, approximately 30 g of 2-propanol and 0.1 g of 1,4-diazabicyclo[2.2.2]octane (DABCO, catalyst) were added to facilitate the reaction and consume residual unreacted toluene diisocyanate. Then the excess 2-propanol was removed under vacuum distillation. The residual crude product was filtered through diatomaceous earth to produce a light yellowish, viscous fluid weighing 198 g.

EXAMPLE 5

Reaction Product of S-2-Hydroxylpropyl O,O-Di-(4-methyl-2pentyl) Phosphorodithioate and Toluene 2,4-Diisocyanate, The procedure of Example 4 was followed with the following exceptions: equimolar product of Example 2 was used instead of product of Example 1, and no catalyst was used.

EXAMPLE 6

Reaction Product of S-2-Hydroxypropyl O,O-Di-(4-methyl-2-entyl) Phosphorodithioate and Hexamethylene Diisocyanate The procedure of Example 5 was followed with the following exceptions: equimolar hexamethylene diisocyanate was used instead of toluene diisocyanate, and catalytic amount of 1,4-diazabicyclo[2.2.2]octane was used.

EXAMPLE 7

Reaction Product of S-2-Hydroxypropyl O,O-Di-(4-methyl-2-pentyl) Phosphorodithioate. Toluene 2,4-Diisocyanate, and $C_{11}$ to $C_{14}$ Branched Akylamine The procedure of Example 5 was followed with the following exceptions: twice the amount of toluene 2,4-diisocyanate was used (equimolar S-2-hydroxypropyl O,O-di-(4-methyl-2-pentyl) phosphorodithioate and TDI), and equimolar alkyl amine (commercially available under the tradename Primene 81R by Rohm and Haas Company, a $C_{11}$ to $C_{14}$ branched, alkylamine) was subsequently used.

EXAMPLE 8

Reaction Product of S-2-Hydroxypropyl O,O-Di-(2-methyl-1-propyl) Phosphorodithioate, Toluene 2,4-Diisocyanate, and Dibutylamine The procedure of Example 7 was followed with the following exceptions: equimolar S-2-hydroxypropyl, O,O-di-(2-methyl-1-propyl) phosphorodithioate (product of Example 3) was used instead of S-2-hydroxypropyl O,O-di-(4-methyl-2-pentyl) phosphorodithioate (product of Example 5). Also, in the subsequent reaction, equimolar dibutylamine was used instead of the $C_{11}$ to $C_{14}$ branched alkylamine.

EXAMPLE 9

Reaction Product of S-2-Hydroxypropyl O,O-Di-(2-methyl-1-propyl) Phosphorodithioate, Toluene 2,4-Diisocyanate, and bis(2-hydroxyethyl) cocoamine The procedure of Example 8 was followed with only one exception: equimolar bis(2-hydroxyethyl) cocoamine (commercially available under the trade name "Ethomeen C-12 manufactured by Akzo Chemie America) was used instead of dibutylamine.

EXAMPLE 10

Reaction Product of S-2-Hydroxypropyl O,O-Di-(2-methyl-1-propyl) Phosphorodithioate, Toluene 2,4-Diisocyanate, and bis(2-hydroxyethyl)cocoamine The procedure of Example 9 was followed with only one exception: catalytic amount of 1,4-diazabicyclo[2.2.2]octane was used.

EVALUATION OF THE PRODUCT

The reaction product was blended in a concentration of 1 wt % in a 200 second, solvent refined paraffinic neutral mineral oil and evaluated for antioxidant performance in the Catalytic Oxidation Test at 325° F. for 40 hours (Table 1) and in the Catalytic Oxidation Test at 325° F. for 72 hours (Table 2).

In the Catalytic Oxidation Test a volume of the test lubricant was subjected to a stream of air which was bubbled through the test composition at a rate of about 5 liters per hour for the specified number of hours and at the specified temperature. Present in the test composition were metals frequently found in engines, namely:

1) 15.5 square inches of a sand-blasted iron wire;
2) 0.78 square inches of a polished copper wire;
3) 0.87 square inches of a polished aluminum wire; and
4) 0.107 square inches of a polished lead surface.

The results of the test were presented in terms of change in kinematic viscosity (ΔKV), change in neutralization number (ΔTAN) and the presence of sludge. Essentially, the small change in KV meant that the lubricant maintained its resistance to internal oxidative degradation under high temperatures, the small change in TAN indicated that the oil maintained its acidity level under oxidizing conditions.

TABLE 1

| | Catalytic Oxidation Text 40 hours at 325° F. | | | |
|---|---|---|---|---|
| Item | Additive Conc. (wt %) | Change in Acid Number Δ TAN | Percent Change in Viscosity % Δ KV | Sludge |
| Base Oil (200 second, solvent refined, paraffinic neutral, mineral oil) | — | 4.78 | 57.90 | Heavy |
| Example 4 in above base oil | 1.0 | 1.34 | 12.98 | Heavy |
| Example 5 in above base oil | 1.0 | 1.02 | 7.49 | Heavy |
| Example 6 in above base oil | 1.0 | 1.24 | 9.29 | Heavy |

TABLE 2

| | Catalytic Oxidation Text 72 hours at 325° F. | | | |
|---|---|---|---|---|
| Item | Additive Conc. (wt %) | Change in Acid Number Δ TAN | Percent Change in Viscosity % Δ KV | Sludge |
| Base Oil (200 second, solvent refined, paraffinic neutral, mineral oil) | — | 9.60 | 118.9 | Heavy |
| Example 5 in above base oil | 1.0 | 1.56 | 10.98 | Heavy |
| Example 6 in above base oil | 1.0 | 1.78 | 14.05 | Heavy |

TABLE 2-continued

| | Catalytic Oxidation Text 72 hours at 325° F. | | | |
|---|---|---|---|---|
| Item | Additive Conc. (wt %) | Change in Acid Number Δ TAN | Percent Change in Viscosity % Δ KV | Sludge |
| above base oil | | | | |

As shown above, the products of this invention show very good antioxidant activity as evidenced by control of increase in acidity and viscosity.

The ability of the oil containing the additives of the present invention to prevent the wearing down of metal parts under severe operating conditions was tested in the 4-Ball Wear Test. The results of the test were presented in Tables 3 and 4. Following the standard ASTM testing procedure, the test was conducted in a device comprising four steel balls, three of which were in contact with each other in one plane in a fixed triangular position in a reservoir containing the test sample. The test sample was an 80% solvent paraffinic bright, 20% solvent paraffinic neutral mineral oil and the same oil containing about 1.0 wt % of the test additive. The fourth ball was above and in contact with the other three. In one test, the data of which were reported in Table 3, the fourth ball was rotated at 2000 rpm while under an applied load of 60 kg, pressed against the other three balls, the pressure was applied by weight and lever arms. The test was conducted at 200° F. for 30 minutes. In another test, the results of which were reported in Table 4, the fourth ball was rotated at 1800 rpm while under an applied load of 40 kg, pressed against the other three balls, the pressure was applied by weight and lever arms. The test was conducted at 200° F. for 30 minutes, also.

The diameter of the scar on the three lower balls was measured with a low power microscope and the average diameter measured in two directions on each of the three lower balls was taken as a measure of the antiwear characteristics of the test composition. Both tables present data showing the marked decrease in wear scar diameter obtained with respect to the test composition containing the product of the Examples.

TABLE 3

| | Four-Ball Test (60 kg load, 2000 rpm, 30 min., 200° F.) | |
|---|---|---|
| Item | Wear Scar Diameter (mm) | Wear Coefficient, K ($\times 10^{-8}$) |
| Base Oil (80% solvent paraffinic bright, 20% solvent paraffinic neutral mineral oil) | 3.98 | 8207.0 |
| 1% Example 4 in above base oil | 0.70 | 6.9 |
| 1% Example 5 in above base oil | 0.64 | 4.7 |
| 1% Example 6 in above base oil | 0.59 | 3.2 |
| 1% Example 7 in above base oil | 0.75 | 9.4 |
| 1% Example 8 in above base oil | 0.73 | 8.4 |
| 1% Example 9 in above base oil | 2.71 | 1770.0 |
| 1% Example 10 in above base oil | 2.27 | 861.0 |

TABLE 4

| Item | Four-Ball Test (40 kg, 1800 rpm, 30 min., 200° F.) Wear Scar Diameter (mm) | Wear Coefficient, K ($\times 10^{-8}$) |
|---|---|---|
| Base Oil (80% solvent paraffinic bright, 20% solvent paraffinic neutral mineral oil) | 1.54 | 306.3 |
| 1% Example 4 in above base oil | 0.504 | 2.8 |

The results clearly show good antiwear activity by these dithiophosphate-derived urethanes.

What is claimed is:

1. A method of making a reaction product comprising reacting an alkoxylated diorgano phosphorodithioate of the formula:

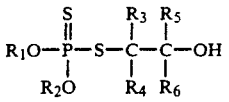

where $R_1$ and $R_2$ are the same or different straight or branched chain hydrocarbyl radicals containing 3 to 30 carbon atoms, $R_3$, $R_4$, $R_5$ and $R_6$ are each independently a hydrogen atom or a hydrocarbyl radical having 1 to 60 carbon atoms and an organo isocyanate characterized by at least one isocyanate group having the structural formula:

—N=C=O the isocyanate group is bonded to the organo group whereby the alkoxylated diorgano phosphorodithioate and the organo isocyanate react to form the reaction product characterized by at least one urethane group.

2. The method as described in claim 1 in which the organo isocyanate is an organo monoisocyanate or diisocyanate.

3. The method as described in claim 2 in which the organo group of the organo isocyanate is aromatic, aliphatic or alicyclic.

4. The method as described in claim 3 in which the isocyanate is toluene-diisocyanate or hexamethylene diisocyanate.

5. The method as described in claim 1 in which $R_1$ and $R_2$ of the alkoxylated diorgano phosphorodithioate is propyl, butyl, pentyl, hexyl, octyl, decyl, dodecyl, octadecyl, eicosyl, ethylhexyl, methylpropyl, methylpentyl and mixtures thereof.

6. The method as described in claim 1 in which the alkoxylated diorgano phosphorodithioate is derived from a phosphorus pentasulfide, an alcohol or phenol and an alkylene oxide.

7. The method as described in claim 6 in which the alkylene oxide is ethylene oxide, propylene oxide, butylene oxide, pentylene oxide, decylene oxide, dodecylene oxide, hexadecylene oxide, octadecylene oxide, styrene oxide, stilbene oxide, cyclohexylene oxide, isomers thereof and mixtures thereof.

8. The method as described in claim 1 which further comprises post reaction of the reaction product with an active hydrogen compound to convert any remaining isocyanate group to a urea or urethane group.

9. The method as described in claim 8 in which the active hydrogen compound is an aliphatic alcohol, a phenol, an amine or an alkanolamine.

10. The method as described in claim 9 in which the aliphatic alcohol is 2-propanol, the amine is a $C_{11}$ to $C_{14}$ branched alkyl amine or dibutylamine and the alkanolamine is bis(2-hydroxyethyl) cocoamine.

11. A method of making a lubricant composition comprising making a reaction product by the steps of:

(a) reacting an alkoxylated diorgano phosphorodithioate of the formula:

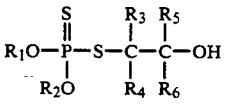

where $R_1$ and $R_2$ are the same or different straight or branched chain hydrocarbyl radicals containing 3 to 30 carbon atoms, $R_3$, $R_4$, $R_5$ and $R_6$ are each independently a hydrogen atom or a hydrocarbyl radical having 1 to 60 carbon atoms and an organo isocyanate characterized by at least one isocyanate group having the structural formula:

—N=C=O the isocyanate group is bonded to the organo group whereby the alkoxylated diorganophosphosdithioate and the organo isocyanate react to form the reaction product characterized by at least one urethane group; and (b) blending the reaction product with a major proportion of a lubricant.

12. The method as described in claim 11 in which the organo isocyanate is an organo monoisocyanate or diisocyanate.

13. The method as described in claim 12 in which the organo group of the organo isocyanate is aromatic, aliphatic or alicyclic.

14. The method as described in claim 13 in which the isocyanate is toluene diisocyanate or hexamethylene diisocyanate.

15. The method as described in claim 11 in which $R_1$ and $R_2$ of the alkoxylated diorgano phosphorodithioate is propyl, butyl, pentyl, hexyl, octyl, decyl, dodecyl, octadecyl, eicosyl, ethylhexyl, methylpropyl, methylpentyl and mixtures thereof.

16. The method as described in claim 11 in which the alkoxylated diorgano phosphorodithioate is derived from a phosphorus pentasulfide an alcohol or phenol and an alkylene oxide.

17. The method as described in claim 16 in which the alkylene oxide is ethylene oxide, propylene oxide, butylene oxide, pentylene oxide, decylene oxide, dodecylene oxide, hexadecylene oxide, octadecylene oxide, styrene oxide, stilbene oxide, cyclohexylene oxide, isomers thereof and mixtures thereof.

18. The method as described in claim 11 which further comprises post reaction of the reaction product with an active hydrogen compound to convert any isocyanate group to a urea or urethane group.

19. The method as described in claim 18 in which the active hydrogen compound is an aliphatic alcohol, a phenol, an amine or an alkanolamine.

20. The method as described in claim 19 in which the aliphatic alcohol is 2-propanol, the amine is a $C_{11}$ to $C_{14}$ branched alkyl amine or dibutylamine and the alkanolamine is bis(2-hydroxylethyl) cocoamine.

21. The method as described in claim 11 in which the lubricant is a mineral oil or synthetic oil or blend thereof.

22. The method as described in claim 21 in which the lubricant composition is a grease.

23. The method as described in claim 11 in which the minor multifunctional amount of the reaction product is 0.01 to 10 wt.% based on the total weight of the lubricant.

* * * * *